US008801118B2

(12) United States Patent
Park et al.

(10) Patent No.: US 8,801,118 B2
(45) Date of Patent: Aug. 12, 2014

(54) KNOB ASSEMBLY AND WASHING MACHINE HAVING THE SAME

(71) Applicant: Samsung Electronics Co., Ltd., Suwon-si (KR)

(72) Inventors: Sung Soo Park, Seoul (KR); Kyung Hwan Lee, Suwon-si (KR); Hong Yeol Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/707,983

(22) Filed: Dec. 7, 2012

(65) Prior Publication Data

US 2013/0145894 A1 Jun. 13, 2013

(30) Foreign Application Priority Data

Dec. 9, 2011 (KR) ..... 10-2011-0132210

(51) Int. Cl.
*A47K 1/04* (2006.01)

(52) U.S. Cl.
USPC ..... 312/228; 74/553

(58) Field of Classification Search
USPC ..... 312/228, 229, 305, 223.1; 74/504, 553; 16/441; 200/316
See application file for complete search history.

(56) References Cited

U.S. PATENT DOCUMENTS

| | | | | |
|---|---|---|---|---|
| 3,410,247 | A | 11/1968 | Dronberger | |
| 4,798,424 | A * | 1/1989 | Coates et al. | 312/257.1 |
| 4,920,823 | A | 5/1990 | Mohr et al. | |
| 6,112,619 | A * | 9/2000 | Campbell | 74/553 |
| 6,242,064 | B1 * | 6/2001 | Howie, Jr. | 428/35.7 |
| 7,490,492 | B2 * | 2/2009 | Kim et al. | 68/12.27 |
| 2011/0233036 | A1 | 9/2011 | Takeda et al. | |
| 2012/0055764 | A1 * | 3/2012 | Lekmine et al. | 200/4 |
| 2012/0090970 | A1 * | 4/2012 | Yoshida et al. | 200/316 |
| 2013/0228038 | A1 * | 9/2013 | Klimecki | 74/553 |
| 2013/0276572 | A1 * | 10/2013 | Vogt | 74/553 |

FOREIGN PATENT DOCUMENTS

| | | |
|---|---|---|
| DE | 102009002623 | 11/2010 |
| EP | 1248177 | 10/2002 |
| EP | 2341290 | 7/2011 |
| GB | 2130438 | 5/1984 |
| GB | 2236380 | 4/1991 |
| KR | 10-2007-0040606 | 4/2007 |
| KR | 10-2011-0040558 | 4/2011 |
| KR | 10-2011-0042541 | 4/2011 |

OTHER PUBLICATIONS

Extended European Search Report dated Apr. 24, 2013 in corresponding European Patent Application No. 12196100.7.

* cited by examiner

*Primary Examiner* — Daniel Rohrhoff
(74) *Attorney, Agent, or Firm* — Staas & Halsey LLP

(57) ABSTRACT

A knob assembly having a simple structure allowing an easy assembly, and a washing machine having the same includes a cabinet, a control panel assembly disposed at an upper portion of a front side of the cabinet, and a knob assembly rotatably mounted on the control panel assembly to set a washing cycle, wherein the knob assembly includes a rotation knob configured to rotate while connected to the control panel assembly to set the washing cycle or a function according to a degree of rotation, and a knob cover coupled to the rotation knob to surround the rotation knob.

11 Claims, 12 Drawing Sheets

KNOB ASSEMBLY AND WASHING MACHINE HAVING THE SAME

CROSS-REFERENCE TO RELATED APPLICATIONS

This application claims the priority benefit of Korean Patent Applications No. 10-2011-0132210, filed on Dec. 9, 2011 in the Korean Intellectual Property Office, the disclosure of which is incorporated herein by reference.

BACKGROUND

1. Field

The following description relates to a knob assembly configured for a user to manipulate a washing machine, and a washing machine having the same.

2. Description of the Related Art

In general, a washing machine is an apparatus configured to wash laundry by introducing clothes contaminated with dirt into the washing machine together with detergent and water, and then by generating a water stream such that the dirt on the clothes is removed through emulsification of detergent and the friction of the wash water stream.

The washing machine as such is divided into a vertical shaft type washing machine having a drum vertically installed at a body and a drum type washing machine having a drum horizontally installed at a body. The vertical shaft type washing machine performs a wash operation by use of a water current generated as a pulsator disposed inside the drum as the drum rotates forward and backward. In contrast, the drum type washing machine performs a wash operation in a manner that the laundry, as a drum disposed in a horizontal direction rotates forward and backward, is lifted along an inner circumferential surface of the drum together with wash water and then dropped.

In general, the washing machine is provided at an upper portion of a front side of a cabinet thereof with a control panel assembly to control the operation of the washing machine.

The control panel assembly is provided with a knob assembly mounted thereon such that a user sets the washing cycle or the washing time in a simple manner.

The knob assembly, along with a power button, is a portion of the washing machine having the highest frequency of use, and as time goes by, the knob assembly tends to have a decreasing connecting strength and a deformed structure.

In addition, the knob assembly, due to a complicated assembly structure thereof, has a low efficiency of assembly and a high cost of components.

SUMMARY

Therefore, it is an aspect of the present disclosure to provide a knob assemble having a simple structure allowing an easy assembly, and a washing machine having the same.

Additional aspects of the disclosure will be set forth in part in the description which follows and, in part, will be obvious from the description, or may be learned by practice of the disclosure.

In accordance with an aspect of the present disclosure, a washing machine includes a cabinet, a control panel assembly, and a knob assembly. The control panel assembly may be disposed at an upper portion of a front side of the cabinet. The knob assembly may be rotatably mounted on the control panel assembly to set a washing cycle. The knob assembly may include a rotation knob and a knob cover. The rotation knob may be configured to rotate while connected to the control panel assembly to set the washing cycle according to a degree of rotation. The knob cover may be coupled to the rotation knob to surround the rotation knob.

In accordance with an aspect of the present disclosure, a washing machine includes a cabinet, a control panel assembly, and a knob assembly. The control panel assembly may be disposed at an upper portion of a front side of the cabinet. The knob assembly may be rotatably mounted on the control panel assembly to set a washing cycle or a function. The knob assembly may include a rotation knob and a knob cover. The rotation knob may be configured to rotate in connection with the control panel assembly to set the washing cycle according to a degree of rotation while including at least one guide groove formed at a side wall of the rotation knob. The knob cover may be coupled to the rotation knob to surround the rotation knob while including a knob guide formed at a position corresponding to the guide groove.

The rotation knob may include a coupling portion extending from a lateral side of the rotation knob toward a lower side, and a plurality of coupling hooks radially protruding from an end portion of the coupling portion outward. The knob cover may include a plurality of coupling grooves formed at an inside of a lateral side of the knob cover to correspond to the coupling hooks such that the plurality of coupling hooks are coupled to the plurality of coupling grooves, respectively.

The plurality of coupling hooks may be spaced apart from each other in a circumferential direction around the rotation knob, and the plurality of coupling grooves may be spaced apart from each other in a circumferential direction around the knob cover.

The rotation knob may include a protrusion portion that protrudes from a center portion of the lateral side while extending in a circumferential direction around the rotation knob. The coupling portion may extend from the protrusion portion.

The coupling portion may extend to be inclined in a radially outward direction.

The coupling portion may be inclined at an angle of 15 degrees or below.

The rotation knob may include a guide groove radially formed at a knob side wall that forms the lateral side of the rotation knob. The knob cover may include a knob guide coupled to the guide groove while radially extending from an inner surface of a cover side wall, which forms the lateral side of the knob cover, inward.

The guide groove may be provided in a plurality thereof, and the plurality of guide grooves may be spaced apart from each other in a circumferential direction around the rotation knob at the knob side wall, and the knob guide may be provided in a plurality thereof and the plurality of knob guides may be spaced apart from each other in a circumferential direction around the knob guide at the cover side wall to correspond to the plurality of guide grooves.

The knob cover may include a movement prevention rib protruding from a cover bottom that forms a bottom of the knob cover. The rotation knob may include a fixing hole, which is provided at a knob bottom that forms a bottom of the rotation knob and allows the movement prevention rib to pass therethrough.

The washing machine may further include a rib guide, which is formed from the knob bottom and has an inner surface thereof making contact with an outer surface of the movement prevention rib.

The rotation knob may include a rotation boss that protrudes from a center of a knob bottom that forms a bottom of the rotation knob. The control panel assembly may include a control panel that forms an external appearance of the control panel assembly. The control panel may include a knob mounting portion on which the knob assembly is mounted, and a rod passing hole which is provided at a center of the knob mounting portion to allow the rotation boss to pass therethrough.

The washing machine may further include a rotary switch connected to the knob assembly while being disposed at a rear of the control panel. The rotary switch may include a rotation rod being connected to the rotation boss.

In accordance with an aspect of the present disclosure, a knob assembly includes a rotation knob and a knob cover. The rotation knob may be configured to set a function according to a degree of rotation while rotating. The knob cover may be coupled to the rotation knob to surround the rotation knob.

As described above, the knob assembly and the washing machine having the same can reinforce the coupling strength between the rotation knob and the knob cover through a simple coupling hook structure.

By use of the knob guide and the rib guide, the assembly of the rotation knob and the knob cover is easily performed.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
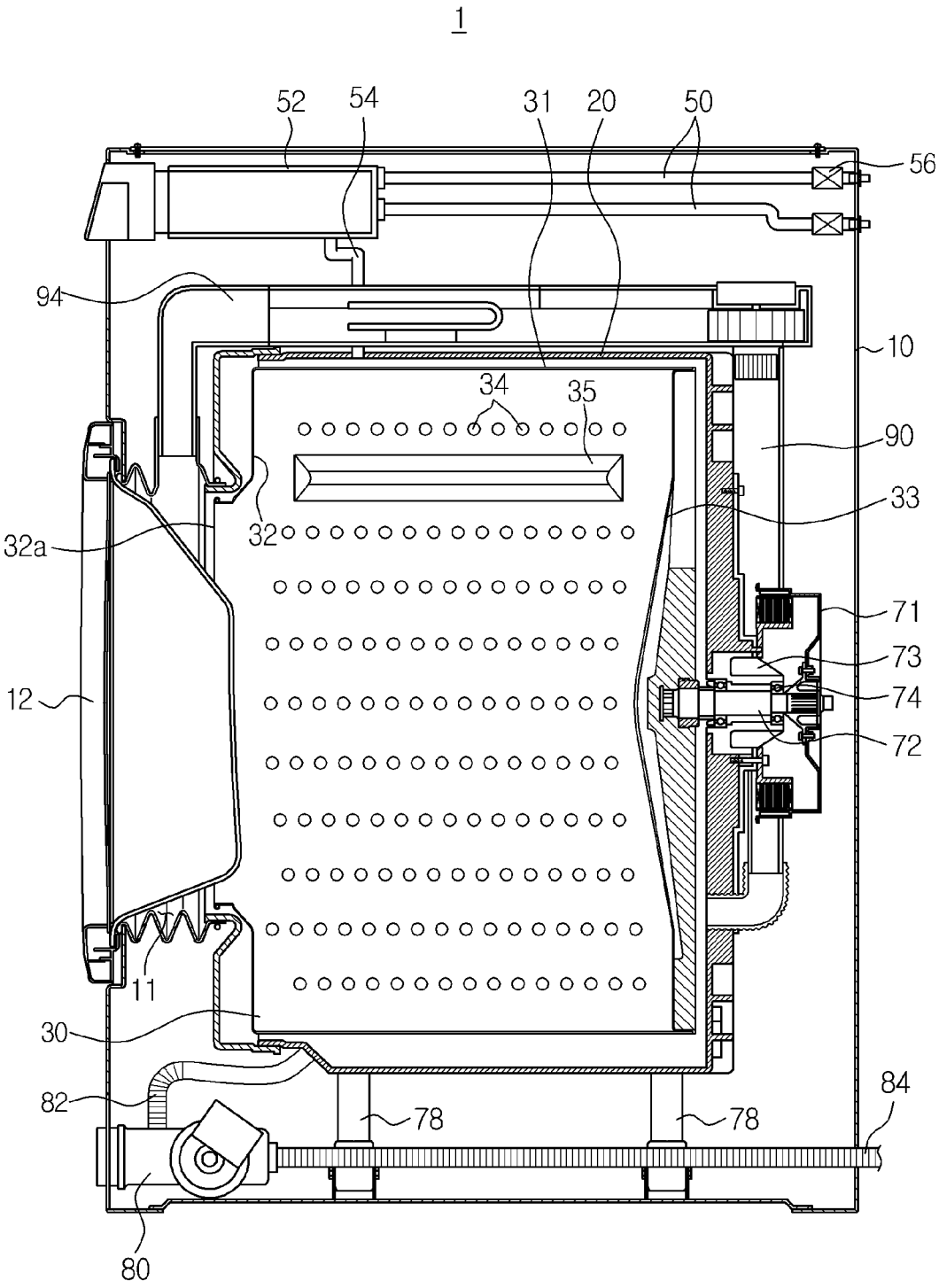
FIG. 1 is a view illustrating a washing machine in accordance with an embodiment of the present disclosure.

Reference will now be made in detail to the embodiments of the present disclosure, examples of which are illustrated in the accompanying drawings, wherein like reference numerals refer to like elements throughout.

Figure 2:
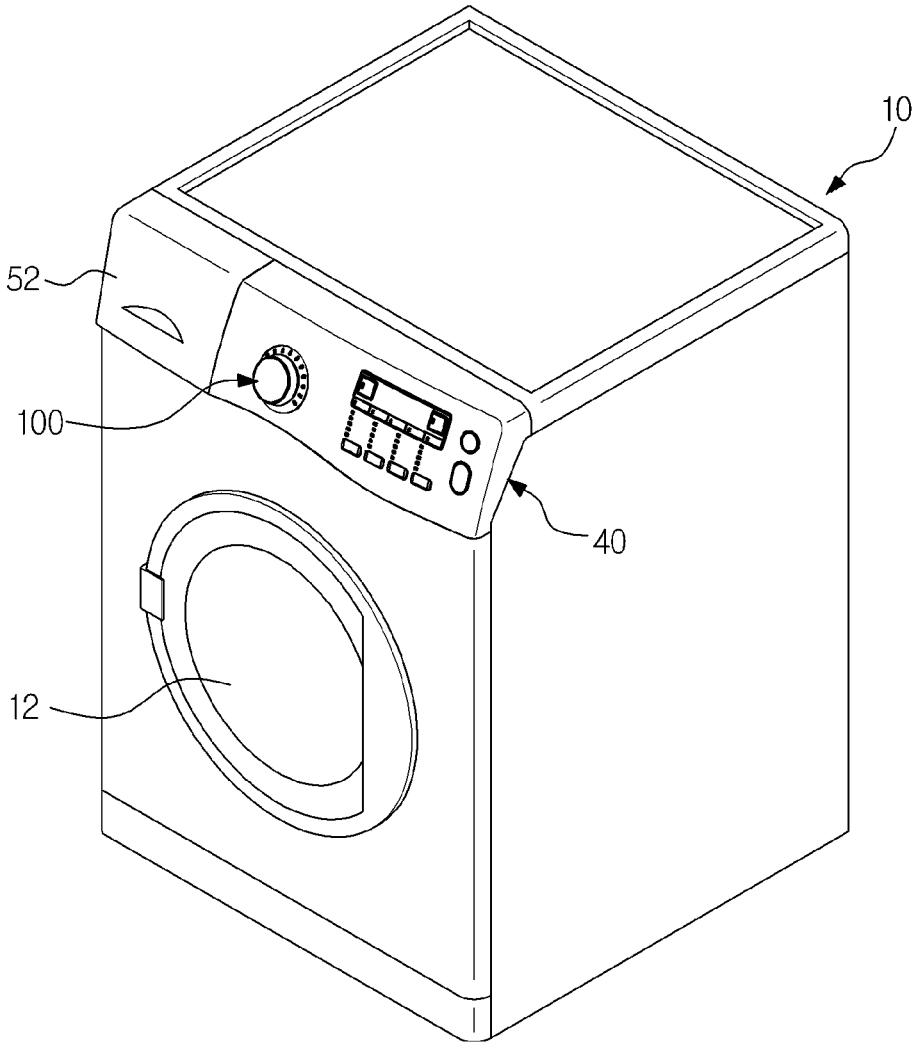
FIG. 2 is a perspective view illustrating the washing machine of FIG. 1.

FIG. 1 is a view illustrating a washing machine in accordance with an embodiment of the present disclosure. FIG. 2 is a perspective view illustrating the washing machine of FIG. 1.

Referring to FIGS. 1 and 2, a washing machine 1 includes a cabinet 10 forming the external appearance of the washing machine 1, a tub 20 disposed inside the cabinet 10, a drum 30 rotatably disposed inside the tub 20, and a motor 71 to drive the drum 30.

An inlet 11 is formed at a front portion of the cabinet 10 such that laundry is introduced into the inside of the drum 30 through the inlet 11. The inlet 11 is opened and closed by a door 12 installed at the front portion of the cabinet 10.

The tub 20 is supported by a damper 78. The damper 78 connects a bottom surface of an inner side of the cabinet 10 to an outer surface of the tub 20.

A water supply pipe 50 is installed at an upper portion of the tub 20 to supply the tub 20 with wash water. One side of the water supply pipe 50 is connected to a water supply valve 56, and the other side of the water supply pipe 50 is connected to a detergent container 52.

The detergent container 52 is connected to the tub 20 through a connection pipe 54. The water being supplied through the water supply pipe 50 is introduced to the inside of the tub 20 together with detergent via the detergent container 52.

A drain pump 80 and a drain hose 84 are installed at a lower portion of the tub 20 to discharge water of the cabinet 10 to the outside of the cabinet 10.

The drum 30 includes a cylindrical portion 31, a front surface panel 32 disposed at a front of the cylindrical portion 31, and a rear surface panel 33 disposed at a rear of the cylindrical portion 31. An opening 32*a* is formed through the front surface panel 32 for entry/exit of the laundry. A driving shaft 72 is connected to the rear surface panel 33 to deliver a driving force from the motor 71.

A plurality of through holes 34 are formed at a circumference of the drum 30 for circulation of wash water, so that the interior space of the drum 30 is communicated with the exterior space of the drum 30.

A plurality of lifters 35 are installed at an inner circumferential surface of the drum 30 such that the laundry is lifted and falls when the drum 30 rotates.

The driving shaft 72 is disposed between the drum 30 and the motor 71. One end portion of the driving shaft 72 is connected to the rear surface panel 33 of the drum 30, and the other end portion of the driving shaft 72 extends to the outside of a rear side wall of the tub 20. As the motor 71 operates the driving shaft 72, the drum 30 connected to the driving shaft 72 rotates on the driving shaft 72.

A bearing housing 73 is installed at the rear side wall of the tub 20 to rotatably support the driving shaft 72. The bearing housing 73 is formed of an aluminum alloy, and may be inserted into the rear side wall of the tub 20 when the tub 20 is formed through an injection molding. A plurality of bearings 74 are installed between the bearing housing 73 and the driving shaft 72 to enable a smooth rotation of the driving shaft 72.

The drain pump 80, a connection hose 82, and the drain hose 84 are provided at a lower portion of the tub 20. The drain pump 80 is configured to discharge water of the tub 20 to the outside of the cabinet 10. The connection hose 82 is configured to connect the tub 20 to the drain pump 80 such that water of the tub 20 is introduced to the drain pump 80. The drain hose 84 is configured to guide water being pumped by the drain pump 80 to the outside of the cabinet 10.

A drying apparatus 90 is mounted on the tub 20. The drying apparatus 90 is configured to dry air at an inside the tub 20 and then supply the dried air to the inside the tub 20.

In a washing cycle, the motor 71 allows the drum 30 to rotate clockwise and counterclockwise at a low speed, and dirt is removed from the laundry inside the drum 30 while repeatedly ascending and descending.

In a spin dry cycle, the motor 71 allows the drum 30 to rotate in one direction at a high speed, and water is separated from the laundry by centrifugal force acting on the laundry.

When the drum 30 rotates during the spin dry process, if the laundry is disposed at a certain position inside the drum 30 without being uniformly distributed, an unbalanced load takes place in the drum 30, and the rotary motion of the drum 30 becomes unstable and a vibration and noise occur. Accordingly, the washing machine 1 is provided with a balancer (not shown) configured to enable a stable rotation of the drum 30. The balancer may be provided in one pair of balancers such that the one pair of balancers may be formed at the front surface panel 32 and the other at the rear surface panel 33.

Meanwhile, a control panel assembly 40 is provided at an upper portion of the front side of the cabinet 10 for the user to control the operation of the washing machine 1.

Figure 3:
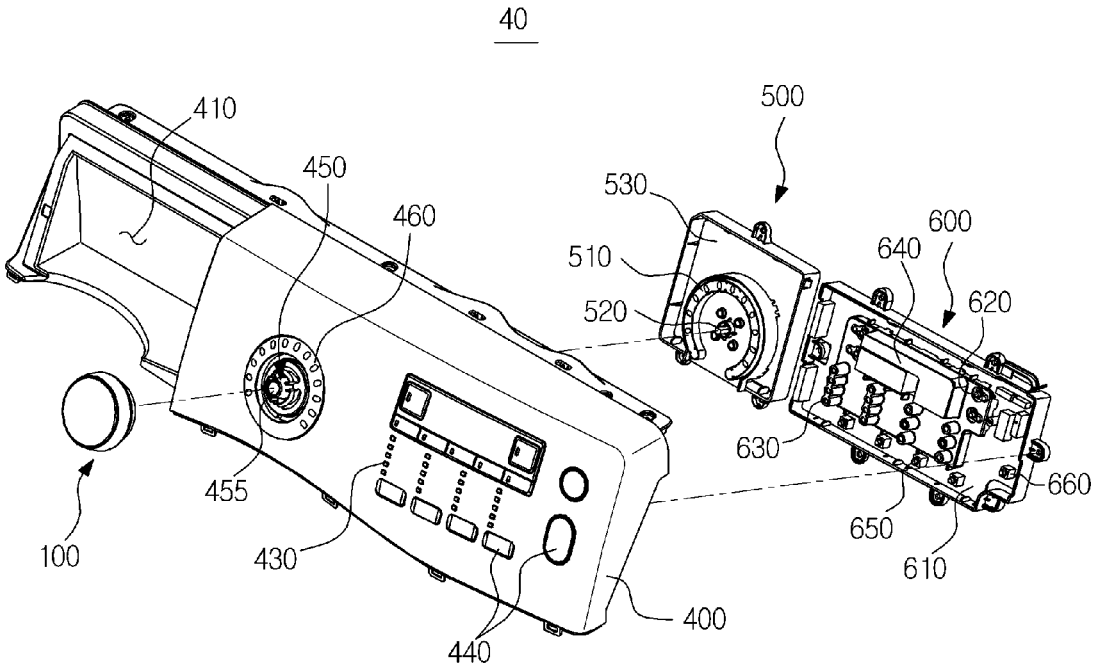
FIG. 3 is a perspective view illustrating a control panel of the washing machine of FIG. 1.

FIG. 3 is a perspective view illustrating a control panel of the washing machine of FIG. 1.

Referring to FIG. 3, the control panel assembly 40 includes a control panel 400 that is inclinedly mounted at the upper portion of the front side of the cabinet (10 in FIG. 1) while forming the external appearance of the control panel assembly 40, a printed circuit board assembly 600 disposed at a rear of the control panel 400, a rotary switch 500 disposed in parallel to the printed circuit board assembly 600 at the rear of the control panel 400, and a knob assembly 100 connected to the rotary switch 500 and mounted on the front surface of the control panel 400.

The printed circuit board 600 includes a printed circuit board 620, and a printed circuit board housing 610 on which the printed circuit board 620 is mounted.

A plurality of first light emitting units 630 configured to display the setting state by a user, and a display device 640 to display the state of the washing machine 1 are installed on the printed circuit board 620.

A plurality of setting switches 650 configured for the user to manipulate the washing machine 1 are disposed at a lower portion of the printed circuit board 620 at the front surface of the printed circuit board housing 610.

With respect to the printed circuit board housing 610, a power switch 660 is disposed at one side of the printed circuit board 620 to power on/off the washing machine 1.

The rotary switch 500 includes a switch housing 530 forming the external appearance of the rotary switch 500, and a rotation rod 520 provided at a center of the switch housing 530 and rotating together with the knob assembly 100 while coupled to the knob assembly 100 to generate a plurality of signals in a step wise manner.

Second light emitting units 510 are arranged to surround the rotation rod 520, and configured to blink to indicate a degree of rotation of the knob assembly 100 as well as a washing cycle corresponding to the degree of rotation. Although the embodiment is illustrated in relation that the washing cycle is selected according to the degree of rotation of the knob assembly 100, the present disclosure is not limited thereto. Other functions may be set through the knob assembly 100 besides the washing cycle.

The control panel 400 is formed therein with a detergent container accommodating hole 410 that passes through a portion of the control panel 400 such that the detergent container 52 is detachable from the inside of the cabinet 10.

The control panel 400 is provided at a center thereof with a knob mounting portion 450 on which the knob assembly 100 is mounted and seated. The knob mounting portion 450 is provided at a center thereof with a rod passing hole 455, which is to be described later, allowing a rotation boss (250 in FIG. 4) of the knob assembly 100 to pass therethrough.

The rotary switch 500 is mounted at the rear of the knob mounting portion 450. The rotation boss (250 in FIG. 4) protruding from a center of a knob bottom 215, after passing through the rod passing hole 455, protrudes to the inside of the control panel 400 to be connected to the rotation rod 520 of the rotary switch 500.

A light emitting unit guide portion 460 provided in a ring shape having a hole passing through the control panel 400 is disposed to expose the second light emitting unit 510 of the rotary switch 500 to the front surface of the control panel 400 while surrounding the knob mounting portion 450.

At one side of the control panel 400, a light passing hole 430 and a plurality of buttons 440 are disposed. The light passing hole 430 is configured to transmit light being generated from the first light emitting unit 630 to the front surface of the control panel 400. The plurality of buttons 440 are configured to cover the setting switch 650 and the power switch 660 such that a user may press the switches 650 and 660 in a smooth manner.

A display window 420 is mounted at a position in front of the display device 640 to allow an image generated from the display device 640 to be displayed at the front surface of the control panel 400.

Figure 4:
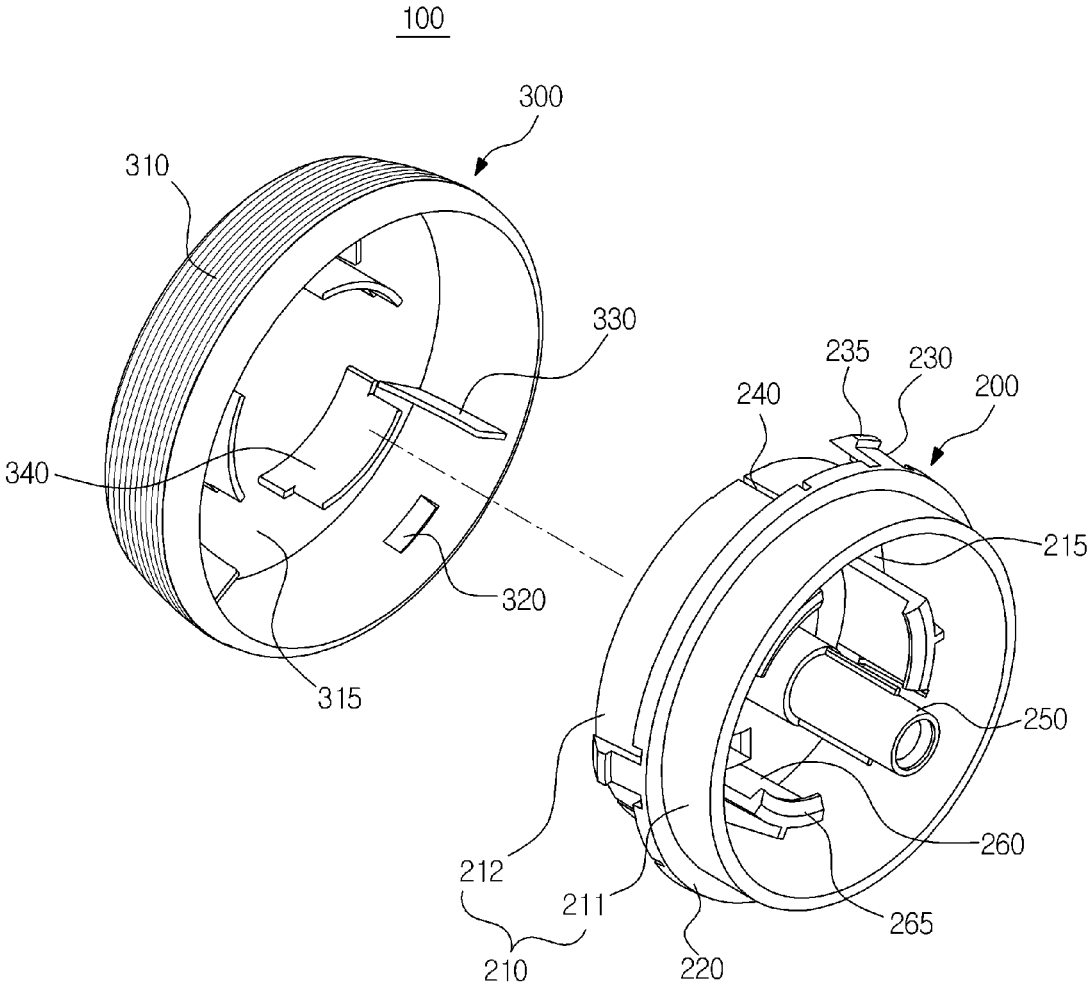
FIG. 4 is a perspective view illustrating a knob assembly of the control panel of FIG. 3.

FIG. 4 is a perspective view illustrating the knob assembly of the control panel of FIG. 3.

Referring to FIG. 4, the knob assembly 100 includes a rotation knob 200 enabling a user to select a washing mode of the washing machine 1 while being coupled to the rotary switch 500, and a knob cover 300 configured to cover the rotation knob 200 to enhance the external appearance of the knob assembly 100 while enabling a user to hold and rotate the knob assembly 100.

As illustrated on the drawings, the rotation knob 200 is insertedly coupled to the knob cover 300, so that the knob assembly 100 is completed.

Hereinafter, the description will be made in relation to the rotation knob 200 and the knob cover 300.

In the description of the present disclosure, for the sake of convenience, it will be understood that "upper side/portion" is referred to as an upper portion of the drawings, and "lower side/portion" is referred to as a lower portion of the drawings.

Figure 5:
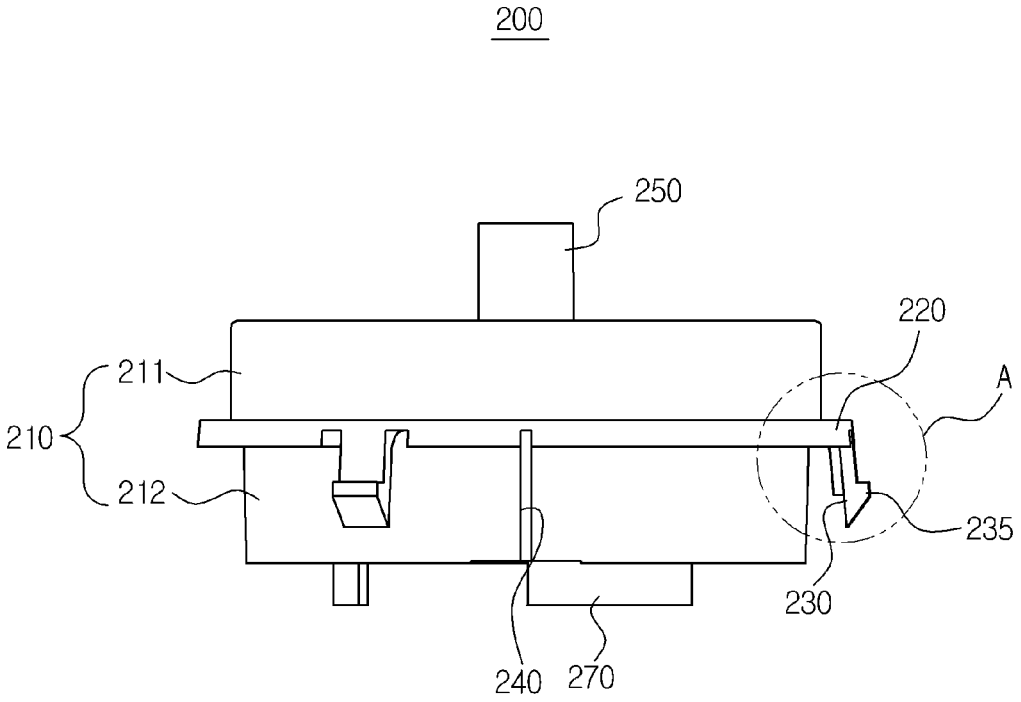
FIG. 5 is a view illustrating a rotation knob of the knob assembly of FIG. 4.

FIG. 5 is a view illustrating the rotation knob of the knob assembly of FIG. 4.

Referring to FIG. 5, the rotation knob 200 is provided in a disc shape, and includes a knob bottom 215 forming a bottom surface of the rotation knob 200, and a knob side wall 210 forming a lateral side of the rotation knob 200 while protruding from an outer end portion of the knob bottom 215 upward. A protrusion portion 220 radially protrudes from a center portion of the knob side wall 210 outward while extending in a circumferential direction around the rotation knob 200.

With respect to the protrusion portion 220, the knob side wall 210 is divided into an upper side wall 211 provided at an upper side of the protrusion portion 220 and a lower side wall 212 provided at a lower side of the protrusion portion 220. A guide groove 240 is radially formed at the lower side wall 212, which is provided in a cylindrical shape. The guide groove 240 has a knob guide 330, which is to be described later, inserted thereinto, such that the knob cover 300 is precisely coupled to the rotation knob 200. In an embodiment of the present disclosure, the guide groove 240 is provided in plurality thereof, and the plurality of guide grooves 240 are spaced apart from each other in the circumferential direction around the knob side wall 210.

A coupling portion 230 is formed while extending from an end of the protrusion portion 220 of the knob side wall 210 toward a lower side. The coupling portion 230 has a lower end portion radially inclined outward. By having the coupling portion 230 inclined as such, the rotation knob 200 is further firmly coupled to the knob cover 300.

A coupling hook 235 is formed while radially protruding from the end portion of the coupling portion 230 outward. The coupling hook 235 is inserted into a coupling groove (320 in FIG. 4) of the knob cover (300 of FIG. 4), which is to be described later, such that the rotation knob 200 is coupled to the knob cover 300.

In an embodiment of the present disclosure, the coupling portion 230 is provided in a plurality thereof, and the plurality of coupling portions 230 are spaced apart from each other in the circumferential direction around the rotation knob 200. The coupling hook 235 is formed at each end portion of the plurality of coupling portions 230. In addition, the coupling groove 320 is provided in plurality thereof to correspond to the plurality of coupling hooks 235, and the plurality of coupling grooves 320 are spaced apart from each other in the circumferential direction around the inner surface of a cover side wall 310.

Figure 6:
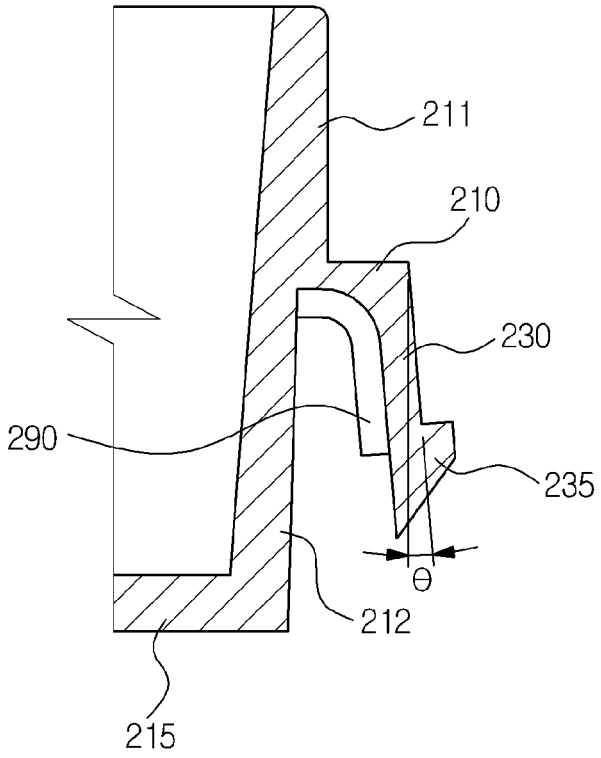
FIG. 6 is an enlarged view illustrating a coupling portion of the rotation knob of FIG. 4.

FIG. 6 is an enlarged view illustrating the coupling portion "A" of the rotation knob of FIG. 5.

Referring to FIG. 6, the coupling portion 230 is formed while protruding and extending from the protrusion portion 220 toward the lower side. The coupling portion 230 is inclined in a manner of increasing distance from the lower side wall 212 while proceeding from an upper end to a lower end of the coupling portion 230.

That is, the coupling portion 230 is inclined with respect to vertical by a tilt angle (θ) from approximately 0 to approximately 15 degrees. Preferably, the tilting angle of the coupling portion 230 may be approximately 5 degrees.

A reinforcing rib 290 is formed at a rear surface of a portion having the coupling hook 235 to reinforce the strength of the coupling portion 230. The reinforcing rib 290 extends along an inner side surface of the protrusion portion 220 while making contact with the rear surface of the coupling portion 230.

When the rotation knob 200 is coupled to the knob cover 300, the reinforcing rib 290 enables the coupling portion 230 to maintain the strength thereof even if the coupling portion 230 is bent toward the lower side wall 212, thereby preventing the coupling portion 230 from being broken. In addition, after the rotation knob 200 is completely coupled to the knob cover (300 in FIG. 4), the reinforcing rib 290 enables the coupling portion 230 to return to the original state such that the coupling hook 235 is firmly inserted into the coupling groove (320 in FIG. 4). Accordingly, the knob cover 300 is strongly coupled to the rotation knob 200.

Figure 7:
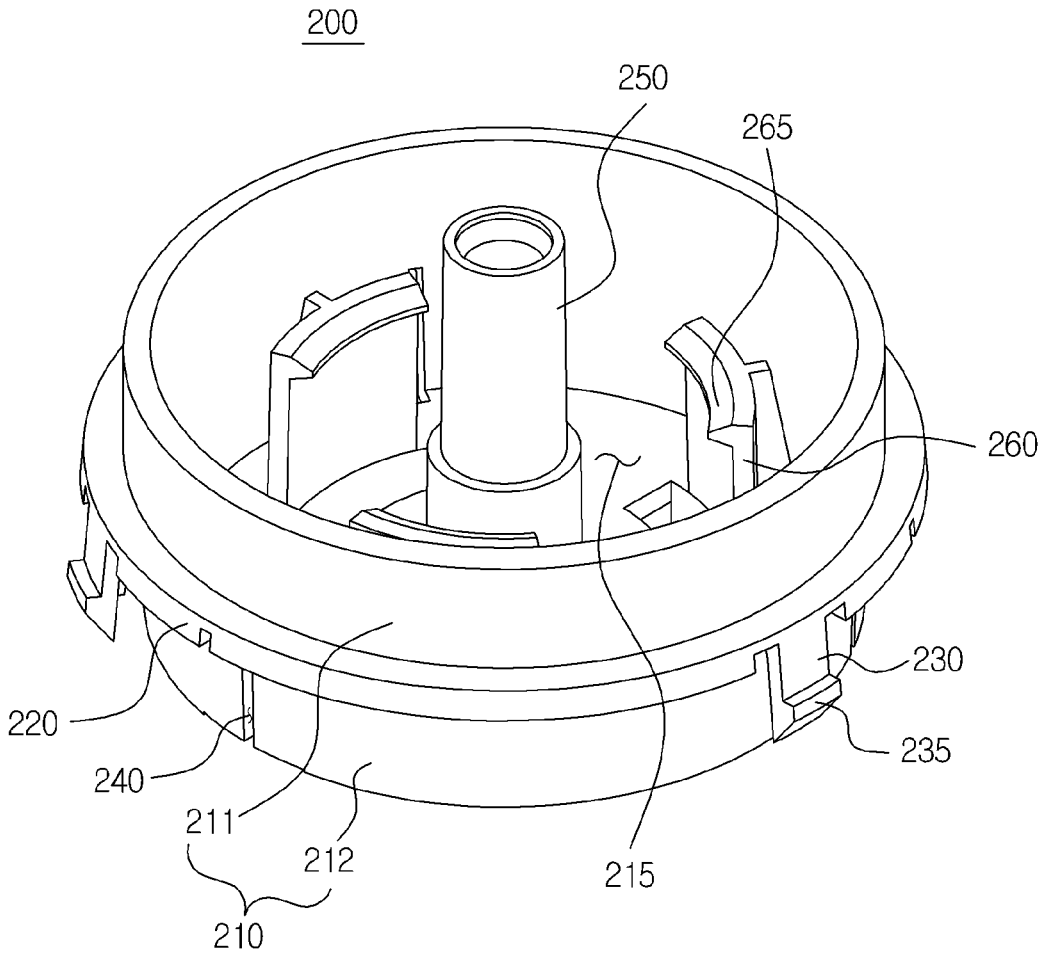
FIG. 7 is a perspective view of the rotation knob of FIG. 4 that is observed from an upper side.

FIG. 7 is a perspective view of the rotation knob of FIG. 4 that is observed from an upper side.

Referring to FIG. 7, the rotation boss 250 and mounting portions 260 are formed while protruding to the upper side from the knob bottom 215.

The rotation boss 250, while passing through the rod through hole (455 in FIG. 3) formed on the knob mounting portion (450 in FIG. 3) of the control panel (400 in FIG. 3), is connected to the rotation rod (520 in FIG. 3) of the rotary switch (500 in FIG. 3).

The mounting portions 260 protruding from the knob bottom 215 to the upper side are arranged in the circumferential direction around the knob bottom 215. A mounting hook 265 is formed at an upper end portion of the mounting portion 260 while protruding toward the rotation boss 250. The mounting hook 265 is coupled to the knob mounting portion (450 in FIG. 3) of the control panel (400 in FIG. 3) such that the knob assembly 100 is mounted on the control panel (400 in FIG. 3).

Although an embodiment of the present disclosure illustrates the mounting portion 260 provided in a plurality of three thereof, the present disclosure is not limited thereto. The number of the mounting portions 260 may vary depending on the requirements of design.

Figure 8:
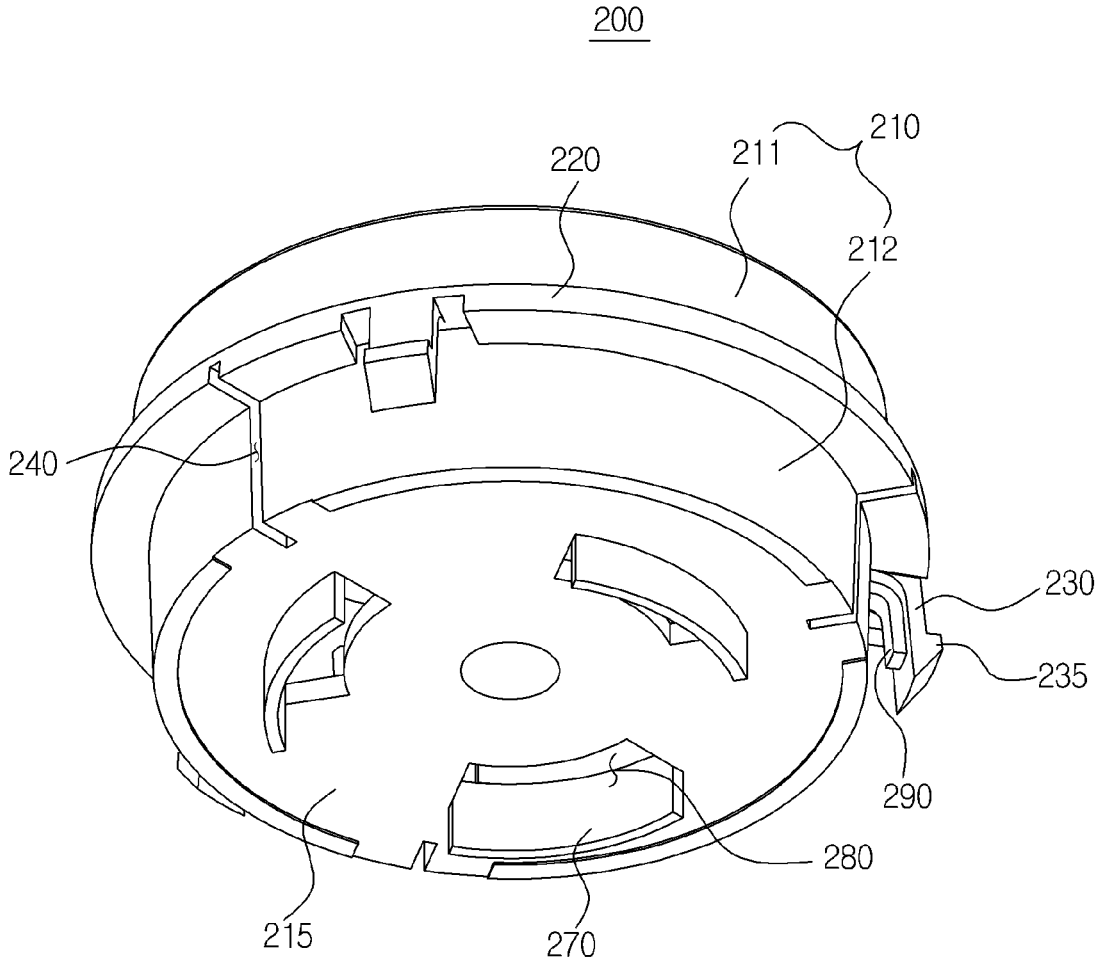
FIG. 8 is a perspective view of the rotation knob of FIG. 4 that is observed from a lower side.

FIG. 8 is a perspective view of the rotation knob of FIG. 4 that is observed from a lower side.

Referring to FIG. 8, a fixing hole 280 is formed while passing through the knob bottom 215. A movement prevention rib (340 in FIG. 4) of the knob cover 300 that is to be described later is inserted into the fixing hole 280.

A rib guide 270 is formed while protruding from the knob bottom 215 downward. The rib guide 270 is formed at a portion of the knob bottom 215 at which the fixing hole 280 is formed. That is, an outer surface of the movement prevention rib 340 inserted into the fixing hole 290 makes contact with an inner surface of the rib guide 270 such that the rib guide 270 is disposed to support the movement prevention rib 340.

The rib guide 270, by guiding the movement prevention rib 340, which is to be described, prevents the movement prevention rib 340 from being broken when the rotation knob 200 is coupled to the knob cover 300, and enables the rotation knob 200 to be coupled to the knob cover 300 at a precise position.

Figure 9:
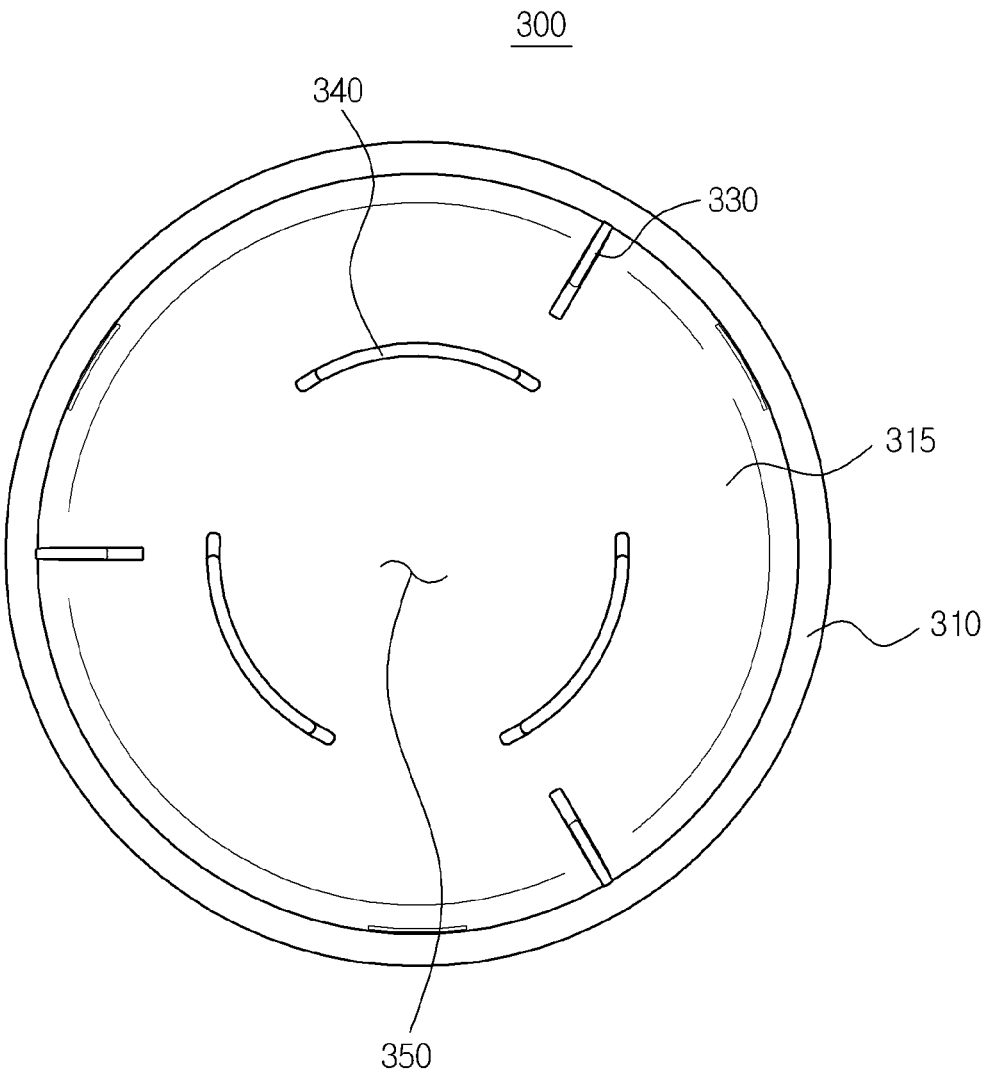
FIGS. 9 and 10 are views illustrating a knob cover of the knob assembly of FIG. 4.
Figure 10:
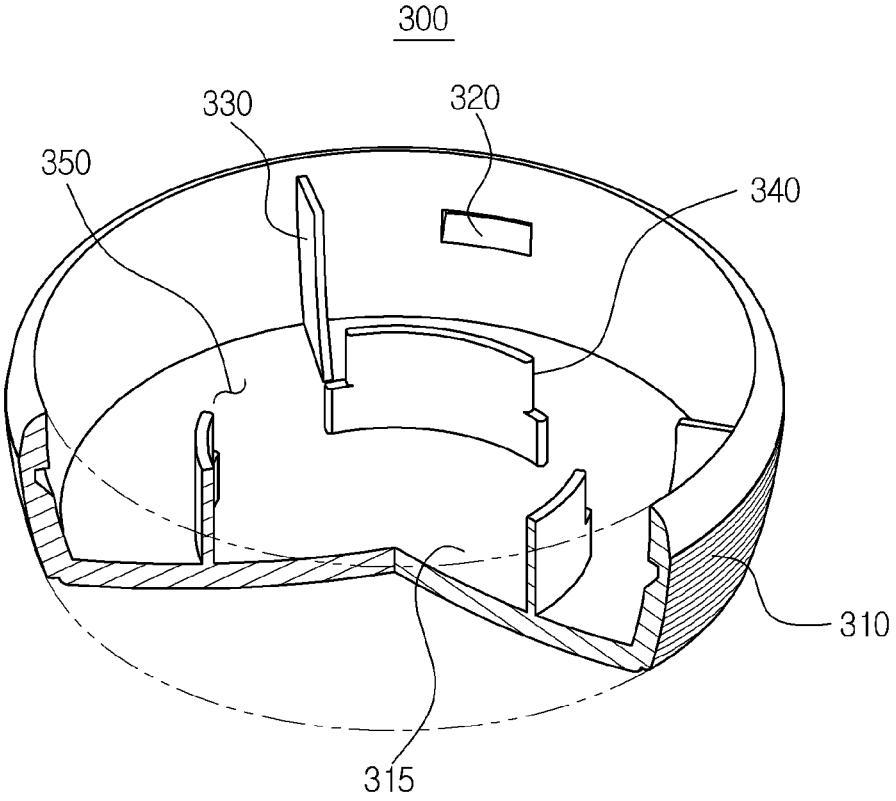

FIGS. 9 and 10 are views illustrating the knob cover of the knob assembly of FIG. 4.

Referring to FIGS. 9 and 10, the knob cover 300 is provided in the form of a disc, and includes a cover bottom 315 forming a bottom surface of the knob cover 300 and a cover side wall 310 forming a lateral side of the knob cover 300 while protruding from an outer end portion of the cover bottom 315 upward.

An insertion hole 350 is formed while being surrounded by the cover side wall 310 such that the rotation knob 200 is inserted into the insertion hole 350. The insertion hole 350 has the same diameter as that of the protrusion portion 220 of the rotation knob 200. As the insertion hole 350 has the same diameter as that of the protrusion portion 220 of the rotation knob 200, the rotation knob 200, being inserted into the knob cover 300, is firmly fixed without movement at the inside the knob cover 300. In accordance with an embodiment of the present disclosure, the protrusion portion 220 may have a diameter smaller than that of the insertion hole 350.

The plurality of coupling grooves 320 and the plurality of knob guides 330 formed at the inner surface of the cover side are arranged along the inner circumference of the cover side wall 310.

The coupling groove 320 is formed by being recessed from the inner surface of the cover side wall 310 to allow the coupling hook (235 in FIG. 7) of the rotation knob 200 to be inserted thereinto. The coupling groove 320 is provided in a predetermined number corresponding to the number of the coupling portions 230 at a position corresponding to the coupling hook 235. Although the coupling portion 230 is provided in three units thereof and the coupling groove 320 is provided in three units thereof in accordance with an embodiment of the present disclosure, the coupling portion 230 and the coupling groove 320 may be provided in other numbers of units more or less than three.

The knob guide 330 is formed while radially protruding from the inner surface of the cover side wall 310 inward. The knob guide 330 is provided in plurality thereof, and the plurality of knob guides 330 are spaced apart from each other in the circumferential direction along the inner surface of the cover side wall 310.

The knob guide 330 is inserted into the guide groove (240 in FIG. 7) of the rotation knob 200 when the rotation knob 200 is mounted on the knob cover 300, so that the rotation knob 200 is coupled to the knob cover 300 at a precision position. When the rotation knob 200 is needed to be mounted on the knob cover 300, if the knob cover 300 is observed from an upper side as in FIG. 9, the position of the coupling groove 320 is not easily determined. However, by adjusting the knob guide 300 to the guide groove 240, the coupling hook 235 is precisely inserted into the coupling groove 320, so that the rotation knob 200 is easily assembled to the knob cover 300.

The movement prevention rib 340 is formed while protruding from the cover bottom 315 upward. The movement prevention rib 340 is disposed to pass through the fixing hole 280 formed at the knob bottom 215 of the rotation knob 200, when the rotation knob 200 is coupled to the knob cover 300. Because the movement prevention rib 340 has the same width as that of the fixing hole 280, if the movement prevention rib 340 is disposed to pass through the fixing hole 280, the fixing hole 80 firmly fixes the movement prevention rib 340. Accordingly, even if the washing machine 1 generates vibration while performing the washing operation, the rotation knob 200 and the knob cover 300 coupled to each other maintains the coupling state without moving against each other.

As described above, the rib guide 270 is disposed to allow the inner surface of the rib guide 270 to make contact with the outer surface of the movement prevention rib 340 when the rotation knob 200 is coupled to the knob cover 300. Accordingly, when the rotation knob 200 starts being inserted into the knob cover 300, the knob guide 330 allows the rotation knob 200 to be disposed at a position at which the coupling hook 23 is precisely inserted into the coupling groove 320, and the rib guide 270 allows the rotation knob 200 to be disposed at a position at which the movement prevention rib 340 is precisely inserted into the fixing hole 280.

In an embodiment, the movement prevention rib 340 is provided in a plurality thereof, and the plurality of movement prevention ribs 340 are spaced apart from each other in the circumferential direction around the knob cover 300 while protruding from the cover bottom 315. The rib guide 270 is provided in a plurality thereof to correspond to the movement prevention ribs 340, and the plurality of rib guides 270 are spaced apart from each other in the circumferential direction around the rotation knob 200.

A hair line is formed at an outer surface of the cover side wall 310. The hair line is formed along the circumference of the cover side wall in a horizontal direction. The outer surface of the cover side wall 310 refers to a portion of the knob assembly 100 that is directly held by a user. The hair line formed on the portion provides an agreeable touch for a user to manipulate the knob assembly 100 while improving the aesthetic quality of the knob assembly 100.

In order to form the hair line along the circumference of the outer surface of the cover side wall 310 that is provided in a curved shape, a brush configured to form the hair line is rotated together with the knob cover 300 on which the hair line is formed.

The brush configured to form the hair line may be provided in at least one unit thereof.

In addition, the cover side wall 310 may be formed in an inclined manner with respect to a vertical direction, and when the hair line is formed, the brush may need to rotate while being inclined to adapt to the tilt of the cover side wall 310.

Figure 11:
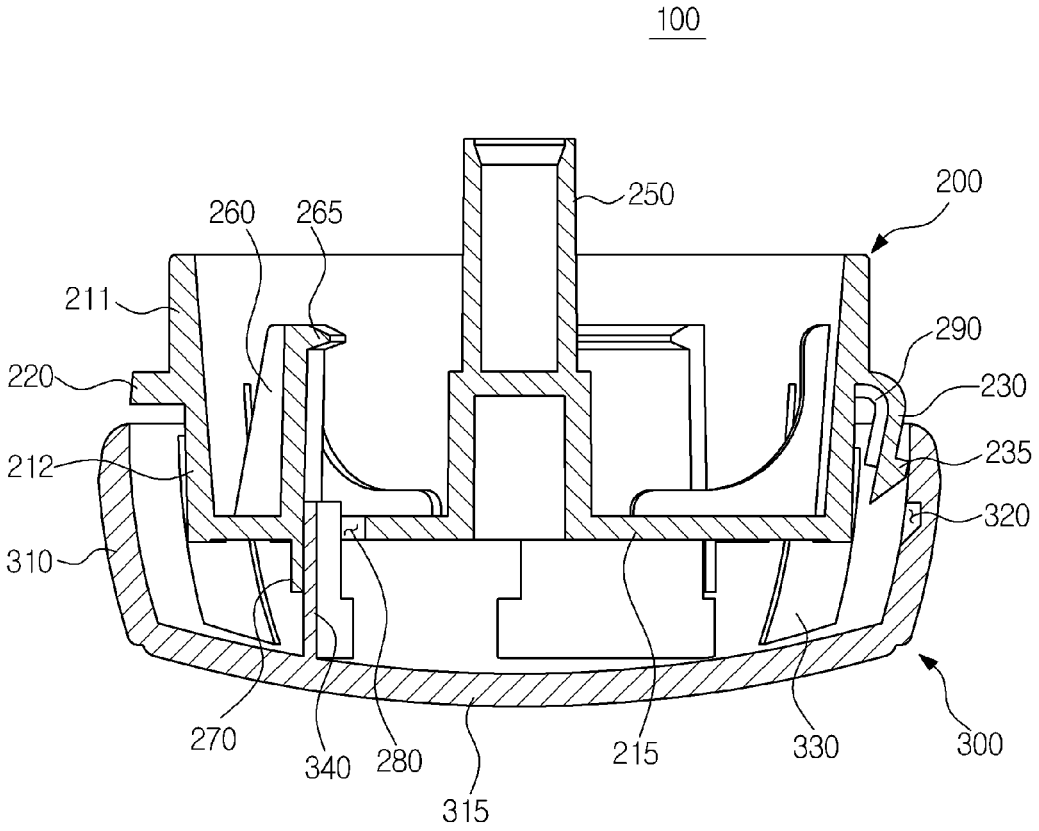
FIGS. 11 and 12 are views illustrating a process of coupling the knob assembly of FIG. 3.
Figure 12:
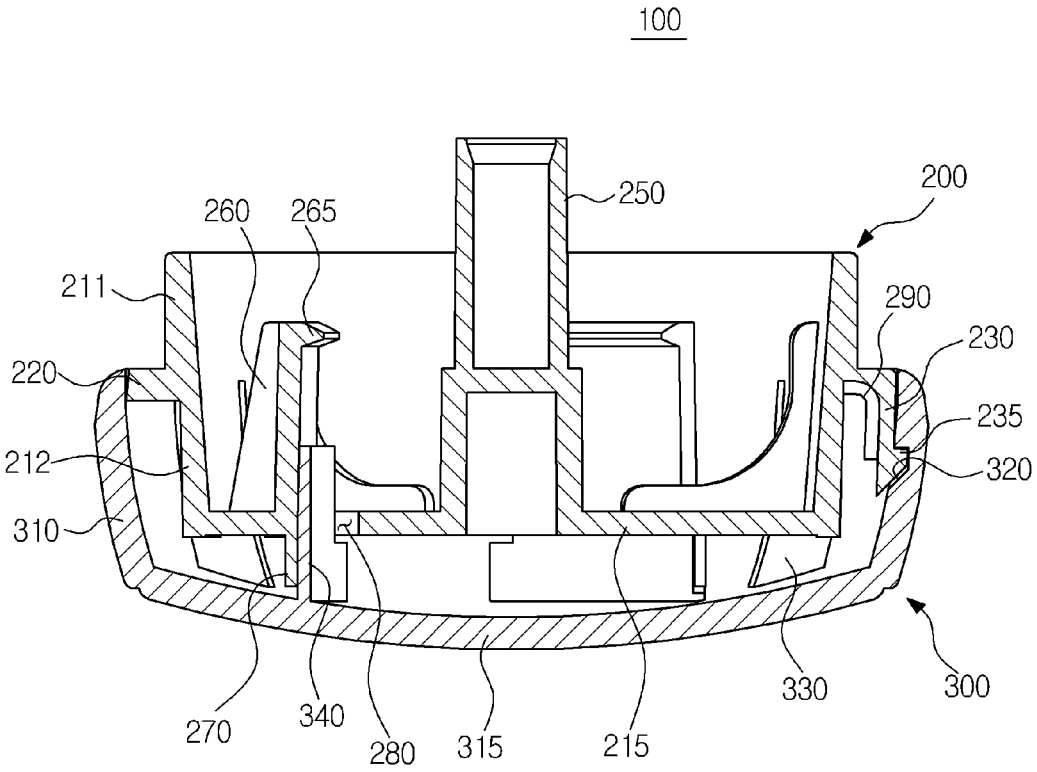

FIGS. 11 and 12 are views illustrating a process of coupling the knob assembly of FIG. 3.

FIG. 11 is a view illustrating a process of inserting a rotation knob into the knob cover.

Referring to FIG. 11, the rotation knob 200 is inserted into the knob cover 300 to assemble the knob assembly 100.

The rotation knob 200 is coupled to the knob cover 300 at a position allowing the coupling hook 235 of the rotation knob 200 to be inserted into the coupling groove 320 of the knob cover 300. The coupling groove 320 of the knob cover 300 is formed by being recessed from a portion of the cover side wall 310, and thus not easily seen with naked eyes in the assembly process. Accordingly, as the rotation knob 200 is rotated to be adjusted with position until the knob guide 330 is inserted into the guide groove 240, the rotation knob 200 is coupled to the cover 300 at a position allowing the coupling hook 235 to be precisely inserted into the coupling groove 320.

As the knob guide 330 starts to be inserted into the guide groove 240, the rotation knob 200 starts to be coupled to the knob cover 300. In this process, the position of the rotation knob 200 is adjusted such that the movement prevention rib 340 is inserted into the fixing hole 280. If the rotation knob 200 is adjusted such that the rib guide 270 is disposed at an outside of the movement prevention rib 340, the movement prevention rib 340 is precisely inserted into the fixing hole 280.

As the rotation knob 200 starts to be inserted into the knob cover 300, the coupling portion 230 formed from the knob side wall 210 in an inclined manner is pressed toward the center of the knob assembly 100. The coupling portion 340 pressed is slid along the cover side wall 310 in a state of being bent due to the material characteristics thereof, and then inserted into the inside the knob cover 300.

Even if the coupling portion 230 is bent as such, the reinforcing rib 290 coupled to the coupling portion 230 prevents the coupling portion 230 from being damaged or permanently deformed as being bent as such.

FIG. 12 is a view illustrating a state of having the knob cover coupled to the rotation knob.

Referring to FIG. 12, when the rotation knob 200 and the knob cover 300 is completely coupled, the coupling hook 235 is inserted into the coupling groove 320.

The coupling hook 235 is bent to be inserted in the coupling process, but when reaching the position of the coupling groove 320, returns to the inclined state again and firmly coupled to the coupling groove 320. In particular, the coupling hook 235 is pressed by the reinforcing rib 290 in the radially outward direction of the knob cover 300, and thus is coupled to the coupling groove 320.

As the coupling strength of the rotation knob 200 and the knob cover 300 is great, even if the knob assembly 100 mounted on the control panel assembly 40 is separated, the knob assembly 100 is separated from the control panel assembly 40 as a whole while preventing the knob cover 300 from being separated from the rotation knob 200.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet;

a control panel assembly disposed at an upper portion of a front side of the cabinet; and a knob assembly rotatably mounted on the control panel assembly to set a washing cycle, wherein the knob assembly comprises:

a rotation knob configured to rotate while being connected to the control panel assembly to set the washing cycle or a function according to a degree of rotation; and a knob cover coupled to the rotation knob to surround the rotation knob, wherein the rotation knob comprises a coupling portion extending from a lateral side of the rotation knob toward a lower side, and a plurality of coupling hooks radially protruding from an end portion of the coupling portion outward, wherein the rotation knob comprises a guide groove radially formed at a knob side wall that forms the lateral side of the rotation knob, and the knob cover comprises a knob guide coupled to the guide groove while radially extending from an inner surface of a cover side wall, which forms the lateral side of the knob cover, inward.

2. The washing machine of claim 1, wherein the knob cover comprises a plurality of coupling grooves formed at an inside of a lateral side of the knob cover to correspond to the coupling hooks such that the plurality of coupling hooks are coupled to the plurality of coupling grooves, respectively.

3. The washing machine of claim 2, wherein the plurality of coupling hooks are spaced apart from each other in a circumferential direction around the rotation knob, and the plurality of coupling grooves are spaced apart from each other in a circumferential direction around the knob cover.

4. The washing machine of claim 2, wherein the rotation knob comprises a protrusion portion that protrudes from a center portion of the lateral side while extending in a circumferential direction around the rotation knob, and the coupling portion extends from the protrusion portion.

5. The washing machine of claim 2, wherein the coupling portion extends to be inclined in a radially outward direction.

6. The washing machine of claim 5, wherein the coupling portion is inclined at an angle of 15 degrees or below.

7. The washing machine of claim 1, wherein the guide groove is provided in a plurality thereof, and the plurality of guide grooves are spaced apart from each other in a circumferential direction around the rotation knob at the knob side wall, and the knob guide is provided in a plurality thereof and the plurality of knob guides are spaced apart from each other in a circumferential direction around the knob cover at the cover side wall to correspond to the plurality of guide grooves.

8. The washing machine of claim 1, wherein:

the knob cover comprises a movement prevention rib protruding from a cover bottom that forms a bottom of the knob cover, and the rotation knob comprises a fixing hole, which is provided at a knob bottom that forms a bottom of the rotation knob and allows the movement prevention rib to pass therethrough.

9. The washing machine of claim 8, further comprising a rib guide that is formed from the knob bottom and has an inner surface thereof making contact with an outer surface of the movement prevention rib.

10. The washing machine of claim 1, wherein:

the rotation knob comprises a rotation boss that protrudes from a center of a knob bottom that forms a bottom of the rotation knob, the control panel assembly comprises a control panel that forms an external appearance of the control panel assembly, and the control panel comprises a knob mounting portion on which the knob assembly is mounted, and a rod passing hole which is provided at a center of the knob mounting portion to allow the rotation boss to pass therethrough.

11. The washing machine of claim 10, further comprising a rotary switch connected to the knob assembly while being disposed at a rear of the control panel, and wherein the rotary switch comprises a rotation rod being connected to the rotation boss.

* * * * *